United States Patent [19]

Le Chatelier et al.

[11] 4,258,541

[45] Mar. 31, 1981

[54] OPEN-END ROTOR WITH THREAD DRAW-OFF TUBE

[75] Inventors: Jacques Le Chatelier, Riedisheim; Michel Kueny, Brunstatt, both of France

[73] Assignee: Societe Alsacienne de Constructions Mecaniques de Mulhouse, France

[21] Appl. No.: 20,853

[22] Filed: Mar. 15, 1979

[30] Foreign Application Priority Data

Mar. 28, 1978 [FR] France ..... 78 08871

[51] Int. Cl.[3] ..... D01H 1/135

[52] U.S. Cl. ..... 57/58.89; 57/341

[58] Field of Search ..... 57/58.89–58.95, 57/341, 344

[56] References Cited

U.S. PATENT DOCUMENTS

| | | | |
|---|---|---|---|
| 3,778,989 | 12/1973 | Schon | 57/58.89 |
| 3,805,505 | 4/1974 | Schuster | 57/58.89 |
| 3,861,131 | 1/1975 | Le Chatelier | 57/58.89 |
| 3,875,731 | 4/1975 | Khomyakov et al. | 57/58.89 |
| 4,011,712 | 3/1977 | Egbers et al. | 57/58.89 |

*Primary Examiner*—John Petrakes

*Attorney, Agent, or Firm*—Holman & Stern

[57] ABSTRACT

A twisting element placed at the outlet of a high-speed rotor of a freed-fiber spinning device is constituted by a portion of turn of helical wire which is jammed against the internal surface of an elbowed tube. The portion of helical turn is located within the elbowed section of the tube and the tube is fixed on the thread delivery orifice of the spinning device.

4 Claims, 1 Drawing Figure

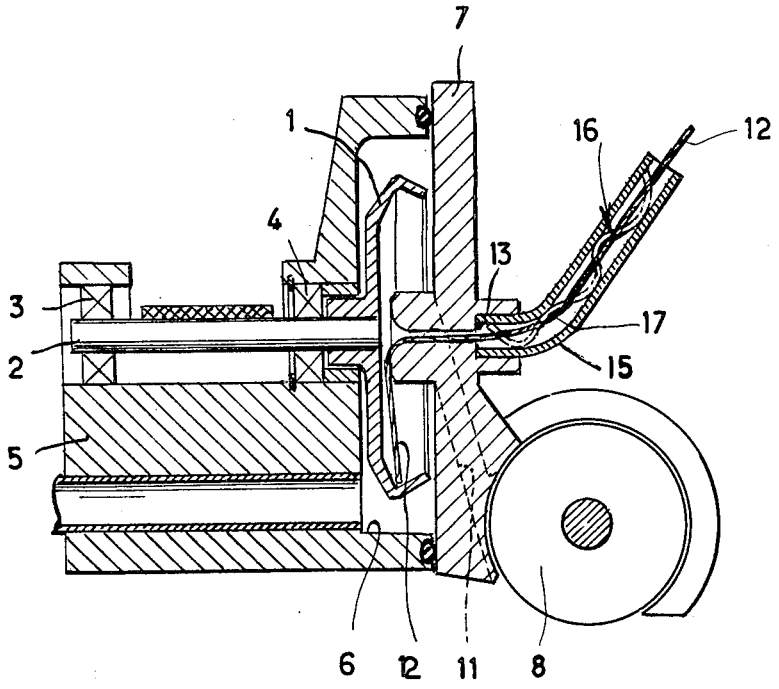
7
1
16
12
4
13
3
17
2
15
5
6
12
11
8

OPEN-END ROTOR WITH THREAD DRAW-OFF TUBE

This invention relates to a freed-fiber spinning device of the type comprising a high-speed rotor of hollow construction in which the thread is delivered in the geometrical axis of the rotor, and a twisting element placed at the outlet of said rotor. Said twisting element has a ridge so arranged that the path of the thread is modified as it passes against the ridge under the action of drawing means and that the ridge passes through the geometrical plane formed by the two strands of thread upstream and downstream of the ridge of said twisting element, said ridge being placed within an enclosure which is subjected to a partial vacuum within the rotor.

The aim of the invention is to construct a device of this type which is of particularly simple and economical design as well as highly efficient.

To this end and in accordance with the invention, the twisting element is constituted by a portion of a single turn of a wire having a number of helical turns jammed against the internal surface of the wall of a tube having an elbowed portion and fixed on the thread delivery orifice of the spinning device, the said portion of helical turn being located within the elbowed portion of the tube whilst the other turns of wire are located outside the said elbowed portion of the tube.

Thus the aforesaid portion of turn constitutes a ridge against which the thread is applied in frictional contact and subjected to an oblique friction force which produces a substantial temporary increase in twist calculated to facilitate the spinning process, the direction of inclination of the helix being clearly chosen so as to correspond to the direction of actual twist of the thread. Moreover, the ridge constituted by a portion of wire has a rounded section and is consequently not liable to result in any damage to the wire.

A more complete understanding of the invention will be gained from the following description and from the accompanying drawing which is given by way of example and in which the single FIGURE illustrates a spinning device equipped with an element in accordance with the invention for increasing the twist of the thread.

The freed-fiber spinning device of conventional type which is shown in the drawing essentially comprises a rotor 1, the shaft 2 of which is rotatably mounted by means of two ball bearings 3, 4 within a body 5 having a cavity 6. The rotor is housed within said cavity and closed by a cover 7 which is adapted to carry a device 8 for feeding fibers. Said fibers are brought tangentially into the rotor 1 through a duct 11 which extends through the cover 7 whilst the thread 12 thus obtained is delivered through a duct which has an orifice 13 and also extends through the cover 7 coaxially with the rotor.

The device according to the invention for increasing the thread twist in the form of a temporary false twist as the thread is delivered from the spinning device comprises an elbowed tube 15 mounted on the thread delivery orifice 13, a helical wire 16 being jammed within said tube in contact with the internal surface of this latter. More precisely, the wire 16 is so arranged that a portion of helical turn 17 of said wire is located in the elbowed portion of the tube and preferably extends on each side of that inner generator-line of said elbowed portion of the tube 15 which has the smallest radius of curvature. Thus the textile thread 12 which is pulled by conventional drawing means (not shown in the FIGURE) is therefore caused to pass over the ridge constituted by the aforementioned portion of helical turn of the wire 16. As a result of frictional contact with said ridge, the thread is subjected to a reaction which tends to produce a temporary increase in twist. This arises from a false twist phenomenon which is subsequently lost as the thread passes out of the tube 15 but has had the time to assist the spinning process. As can readily be understood, the direction of inclination of the helix of the wire 16 corresponds to the direction of twist of the thread which is being formed. Good results are obtained with an angle of inclination of helix of the order of 45°.

The other turns of wire 16, namely the outer turns located beyond the elbowed portion of the tube have practically no useful function apart from the fact that they can serve to complete the work performed by the aforesaid portion of helical turn when the thread subsequently comes into contact with said outer turns as a result of "floating" motion. Said outer turns also serve to fit the active portion of helical turn within the tube and to ensure that the helical spring thus formed by the helical wire 16 and consisting of piano wire, for example, is suitably positioned by jamming against the wall of the tube 15. It would in fact be difficult to ensure that a small length of wire corresponding only to the active portion of helical turn aforesaid is suitably positioned and fixed against the inner face of the elbow of the tube 15.

What is claimed is:

1. An open-end spinning device comprising:

a body having a cavity formed therein and subjected to a partial vacuum;

a high speed rotor of hollow construction having an axis and a generally circular opening coaxial with said axis, said rotor being adapted to rotate on said axis within said cavity of said body;

a cover closing said cavity of said body and facing said opening of said rotor;

a thread delivery duct extending through said cover coaxially with said axis and having a thread exit end; and a thread twist-increasing device comprising: a tube forming an extension of said exit end of said thread delivery duct and having an elbowed portion, and a wire having a number of helical turns jammed against the internal surface of said tube, a portion of a single turn of said wire being located within said elbowed portion of said tube and forming a thread twist-increasing element, the other turns of said wire being located outside said elbowed portion, whereby said thread in said tube engages only said thread twist-increasing element and includes upstream and downstream strands respectively ahead of and behind said thread twist-increasing element, said thread twist-increasing element extending through the geometrical plane formed by said upstream and downstream strands of said thread.

2. A device as claimed in claim 1, wherein the aforesaid portion of helical turn extends on each side of that inner generator-line of the elbowed portion of the tube which has the smallest radius of curvature.

3. A device as claimed in claim 1, wherein the wire is piano wire.

4. A device as claimed in claim 1, wherein the angle of inclination of the wire helix is of the order of 45°.

* * * * *